US007530800B2

(12) United States Patent
Sieben

(10) Patent No.: US 7,530,800 B2
(45) Date of Patent: May 12, 2009

(54) ROTARY DRIVEHEAD FOR DOWNHOLE APPARATUS

(75) Inventor: Jason L. Sieben, Calgary (CA)

(73) Assignee: Kudu Industries Inc., Calgary (CA)

( * ) Notice: Subject to any disclaimer, the term of this patent is extended or adjusted under 35 U.S.C. 154(b) by 779 days.

(21) Appl. No.: 10/905,543

(22) Filed: Jan. 10, 2005

(65) Prior Publication Data

US 2005/0163640 A1 Jul. 28, 2005

(30) Foreign Application Priority Data

Jan. 23, 2004 (CA) ..... 2455742

(51) Int. Cl.
*E21B 43/00* (2006.01)

(52) U.S. Cl. ..... 417/423.14; 166/68.5

(58) Field of Classification Search ..... 417/423.14, 417/65, 423.3, 441, 297; 418/206.1, 205; 210/169, 416.2, 221.1; 166/68.5, 104, 105
See application file for complete search history.

(56) References Cited

U.S. PATENT DOCUMENTS 3,536,169 A * 10/1970 Arnold ..... 188/82.1
4,017,217 A * 4/1977 Lamers ..... 417/214
4,216,848 A 8/1980 Shimodaira
4,372,379 A 2/1983 Kulhanek et al.
4,716,961 A 1/1988 Makins, Jr. et al.
4,797,075 A 1/1989 Edwards et al.
4,993,276 A 2/1991 Edwards
5,358,036 A 10/1994 Mills
5,551,510 A 9/1996 Mills
5,628,578 A 5/1997 McClanahan et al.
5,639,227 A 6/1997 Mills
5,749,416 A 5/1998 Belcher
6,039,115 A 3/2000 Mills
6,079,489 A 6/2000 Hult
6,125,931 A 10/2000 Hult
6,152,231 A 11/2000 Grenke
6,241,016 B1 6/2001 Dedels
6,350,275 B1 2/2002 Vreman et al.
6,371,487 B1 4/2002 Cimbura, Sr.
6,564,911 B2 5/2003 Mills
2001/0050168 A1 12/2001 Hult
2002/0175029 A1 11/2002 Saruwatari et al.
2003/0131987 A1 7/2003 Lam et al.

* cited by examiner

*Primary Examiner*—Michael Cuff
*Assistant Examiner*—Vikansha S Dwivedi
(74) *Attorney, Agent, or Firm*—Bennett Jones LLP

(57) ABSTRACT

A drivehead for driving a drive string of a rotary pump or motor includes a bearing housing including lubricating fluid therein, a driveshaft extending through the bearing housing and connectable into drive communication with the drive string, and a concentric pump disposed in the bearing housing about the driveshaft, the concentric pump selected to pump the lubricating fluid through the bearing housing as driven by the driveshaft.

14 Claims, 6 Drawing Sheets

ROTARY DRIVEHEAD FOR DOWNHOLE APPARATUS

FIELD OF THE INVENTION

The patent application relates to a drivehead for a rotary pump or motor and components therefor.

BACKGROUND OF THE INVENTION

A drivehead is operable to rotatably drive a drive string for a downhole apparatus such as a motor or pump in well pump applications.

A drivehead, including a lubrication pump, a bearing housing and a braking system therefor are described in U.S. Pat. No. 5,358,036 to Mills.

SUMMARY

A drivehead, a drivehead bearing housing, a lubrication pump and a drivehead braking assembly are described herein.

In accordance with a broad aspect of the present invention there is provided a drivehead for driving a drive string of a rotary pump or motor, the drivehead comprising: a bearing housing for containing lubricating fluid therein, a driveshaft extending through the bearing housing and connectable into drive communication with the drive string and a pump disposed in the bearing housing concentric about the driveshaft, the pump selected to pump the lubricating fluid through the bearing housing as driven by the driveshaft.

DETAILED DESCRIPTION OF VARIOUS EMBODIMENTS

A drivehead can be useful for driving a drive string of a downhole rotary motor or pump, such as a downhole rotary progressing cavity pump. In such an application, the drivehead can drive the sucker rod string used to drive the rotor, the drivehead may also provide a bearing for the rotation at surface and may also provide a brake system for controlling the back-spin of the drive string, which stores reactive torque due to torsional stress.

Figure 1:
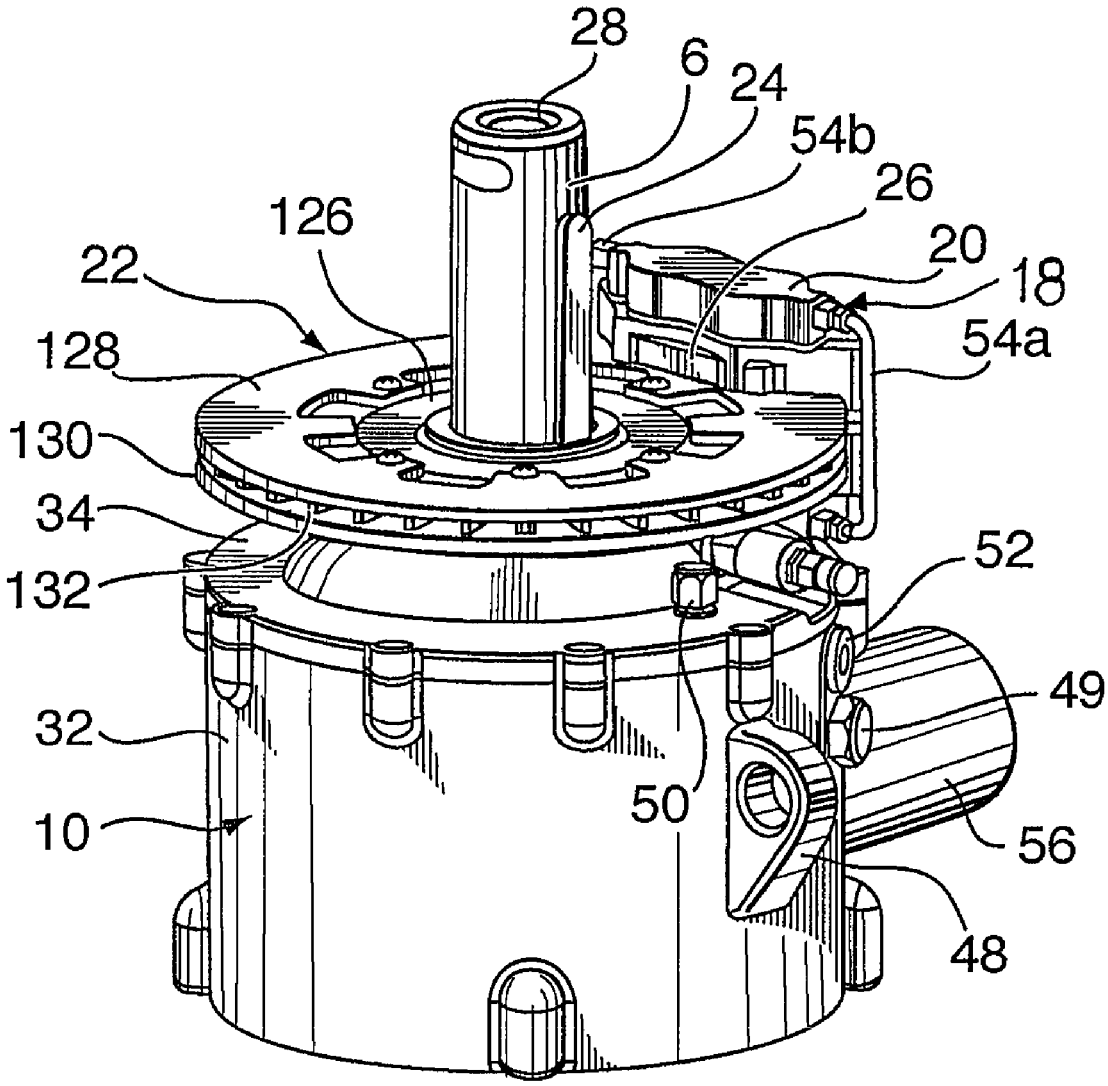
FIG. 1 is a perspective view of a drivehead assembly including a bearing housing and brake assembly.
Figure 2:
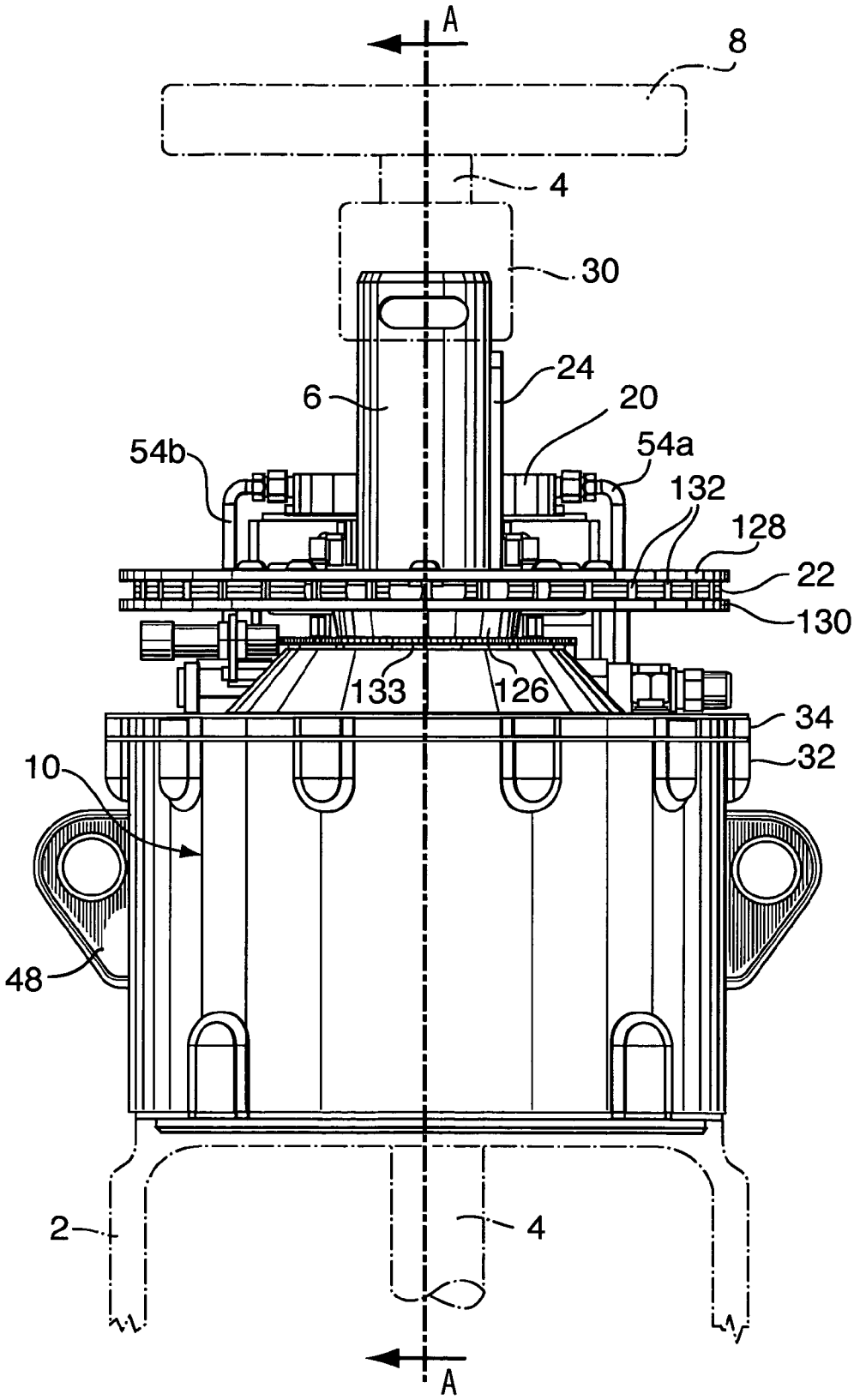
FIG. 2 is a side elevation of another drivehead assembly.
Figure 3:
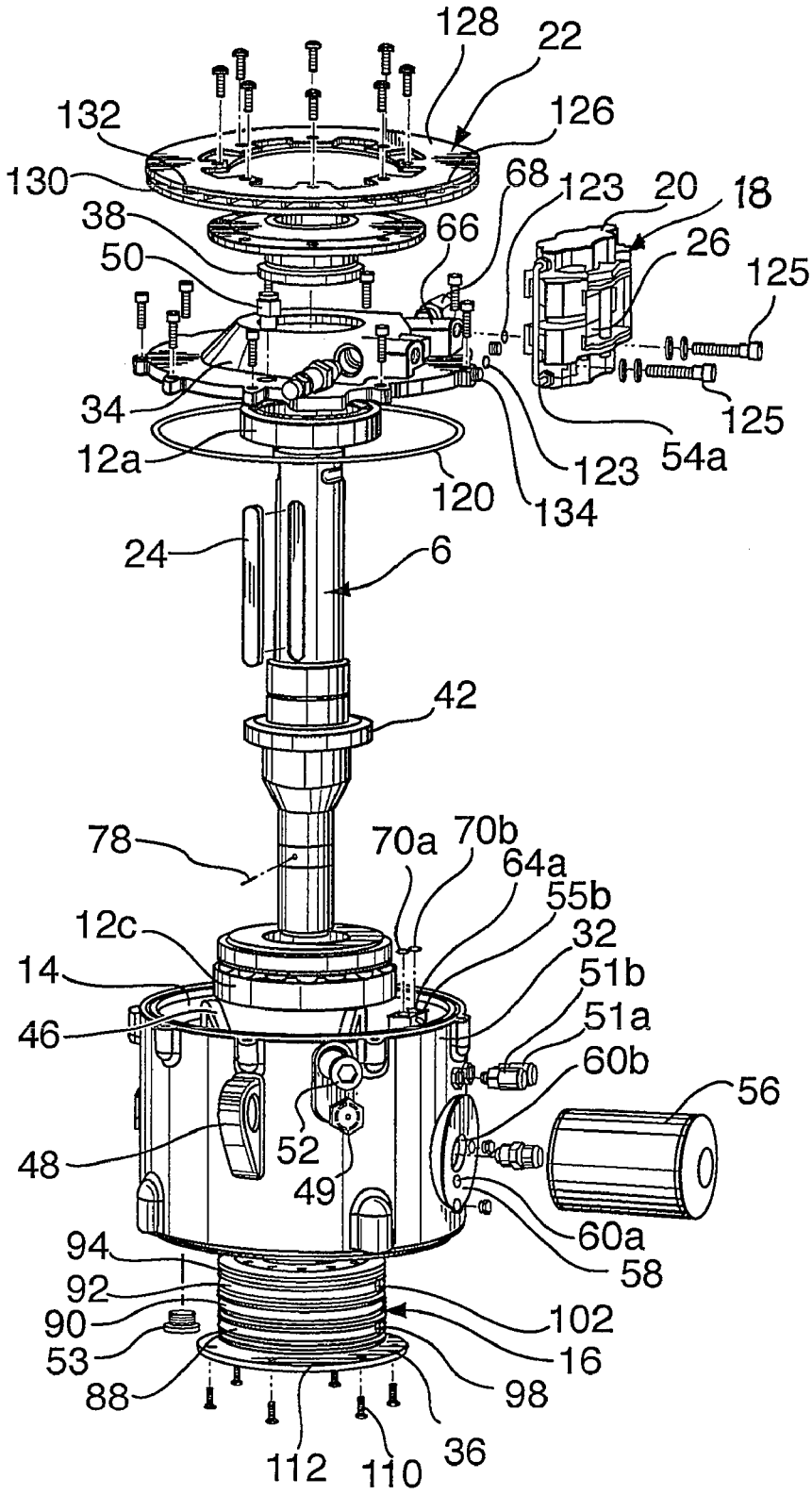
FIG. 3 is an exploded view of the drivehead of FIG. 1.

FIGS. 1 and 2 show views of two embodiments of a drivehead assembly. The frame, sheave and drive system of the drivehead are shown in phantom in FIG. 2, but have been removed from the drivehead assembly of FIG. 1 such that only the bearing housing and brake assembly of the drivehead are illustrated. The bearing housing and brake assembly of FIGS. 1 and 2 differ only in the provision of tachometer components in FIG. 2.

Referring to the Figures, a drivehead can be mountable, for example by a frame 2, at a wellhead to drive and control the rotation of a polish rod 4 that can be connected to a drive string (not shown) of a rotary pump or motor. A drivehead can include a drive shaft 6 that can be connected to a drive system, including a sheave 8, and to polish rod 4. As such, as the sheave can be driven to rotate by the drive system, sheave 8 can drive driveshaft 6 and, therethrough, polish rod 4 to rotate therewith. As such, rotational drive can be conveyed to the downhole pump.

A drivehead further can include a bearing housing 10 including bearings, for example bearings 12*a*-12*c*, therein for supporting rotation of drive shaft 6 and forming a fluid reservoir 14 for a lubricating fluid for bearings 12. Bearing housing 10 can include a pump 16 for pumping the lubricating fluid through the bearings. In an embodiment, pump 16 can be driven by rotation of drive shaft 6 and, in one embodiment, the pump can be bi-directional such that as the drive shaft rotates in one direction the pump directs fluid through a circuit to lubricate the bearings and when the drive shaft rotates in a opposite direction, the fluid can be directed to a circuit through a brake assembly 18 including a hydraulic brake caliper 20, which acts on a brake rotor 22. Brake rotor 22 can be secured by a key 24 to rotate in direct correspondence with drive shaft 6. Fluid pressure at caliper 20 can drive brake pads 26 against brake rotor 22 and this braking action may thereby be transmitted to drive shaft 6 to slow its rotation.

Thus, rotation of drive shaft 6 in a drive direction by sheave 8 and the drive system causes polish rod 4 to rotate and pump 16 to circulate lubrication fluid through bearings 12. However, rotation of the drive shaft in a reverse direction opposite to the drive direction, such as by a release of reactive torque in polish rod 4, causes pump 16 to circulate lubrication fluid such that the reverse rotation can be retarded to prevent the shaft from spin uncontrollably in that opposite, reverse direction. The pump can be selected such that the fluid pressure output by the pump correlates to the speed of rotation of the driveshaft. Thus, the pump can operate so that slowing of driveshaft rotation, for example in the reverse direction, causes a decrease in the fluid pressure output by the pump. This then may reduce the pressure on brake pads 26 so that the braking force can be relieved and the drive shaft can be permitted to spin again in the opposite direction. Increased spinning rates of the shaft in the opposite direction, nonetheless, increases the fluid pressure to the brake caliper which forces the brake pads once again into stronger contact with brake rotor 22, causing the braking action to be correspondingly increased.

Therefore, the illustrated drivehead provides a drive and a bearing support for polish rod drive rotation, bearing lubrication and a self-regulating braking system to release stored torque from the connected drive string in a controlled manner.

Figure 7:
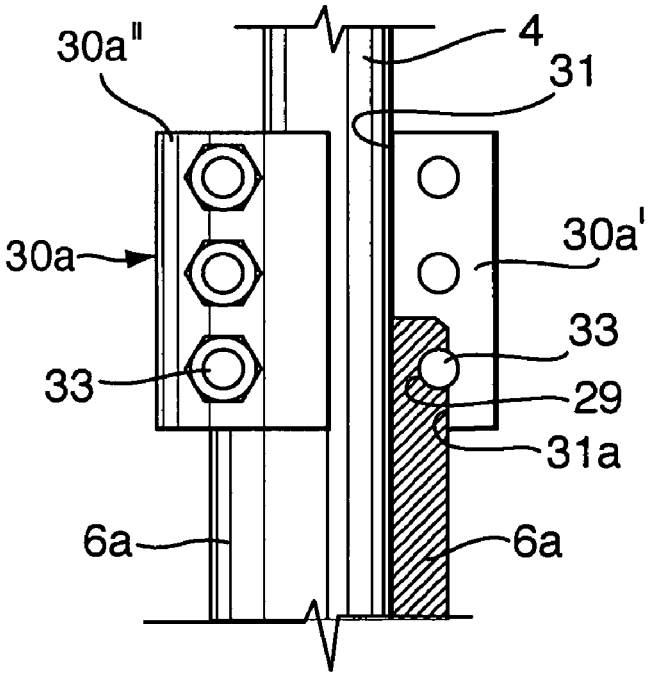
FIG. 7 is a quarter axial section through a polish rod clamp and drive shaft end.

Polish rod 4 can extend upward through an axial bore 28 in drive shaft 6 and can be connected to the drive shaft through a polish rod clamp 30. Polish rod clamp 30 for a progressing cavity pump drivehead connection allows the rod clamp to be keyed for rotational drive communication with the driveshaft. The rod clamp may include a pair of members that form a bore in which the polish rod is positioned during clamping. In one embodiment, as shown in FIG. 7, a rod clamp 30*a* may be used that can be detachably connected, against axial movement, to a drive shaft 6*a*. Rod clamp 30*a* may include a pair of members 30*a*′, 30*a*″ that form a bore 31 in which the polish rod is positioned during clamping. At one end of the bore there may be an enlarged opening 31*a* that is sized to accommodate an end of the drive shaft 6*a* so that the clamp extends over the upper end of the driveshaft. To provide for axial engagement between the driveshaft and the polish rod clamp, driveshaft 6*a* may include a notched portion 29 on its outer surface and a protrusion may be formed in the enlargement 31*a* that engages the notch in the drive shaft. The notch/protrusion can be formed to correspond to permit engagement both rotationally and axially between the drive shaft and the clamp. In the illustrated embodiment, the protrusion is formed by a clamping bolt 33 that serves to secure the pair of clamp members about the polish rod and extends into enlargement 31*a* to form the protrusion. Of course, rotational and axial engagement between the drive shaft and the clamp may also be achieved by forming the notch on the clamp and the protrusion on the drive shaft. Axial engagement of the clamp to the drive shaft can be useful where there exists a risk that the polish rod may be ejected from the drive shaft during operation, as by a break in the drive string.

Drive shaft 6 can extend through bearing housing 10. The bearing housing can be formed in various ways. In the illustrated embodiment, bearing housing 10 may include a main body 32 and a cover 34 that can be sealed and secured together to define fluid reservoir 14. The fluid reservoir provides a fluid bath for bearings 12*a*-12*c* that rotatably support drive shaft 6. An upper seal 38 and a lower seal 40 can define the limits of the reservoir. In the illustrated embodiment, a housing 36 about the pump is sealed against the bearing housing to complete the seal of the bearing housing forming the fluid reservoir. However, of course, other configurations can be used such as by providing, or forming the bearing housing to define, a housing bottom wall.

The bearings can be of any type and in any configuration to support rotation of the drive shaft. In the illustrated embodiments, the bearings include an upper radial bearing 12*a*, a lower radial bearing 12*b* and a thrust bearing 12*c*, for acting between a shoulder flange 42 on the drive shaft and a thrust ledge 44 on the housing.

Housing 10 can further include, for example and if desired, internal ribs 46 that may control fluid circulation and housing strength and lifting lugs 48 for providing a convenient mechanical attachment for lifting the housing. In the illustrated embodiment, the housing may accommodate a fluid level sight glass 49, a breather 50 to maintain atmospheric pressure within the housing, test nozzles 51*a*, 51*b*, fill plugs 52, a drain plug 53, and/or other items, as desired.

Figure 6:
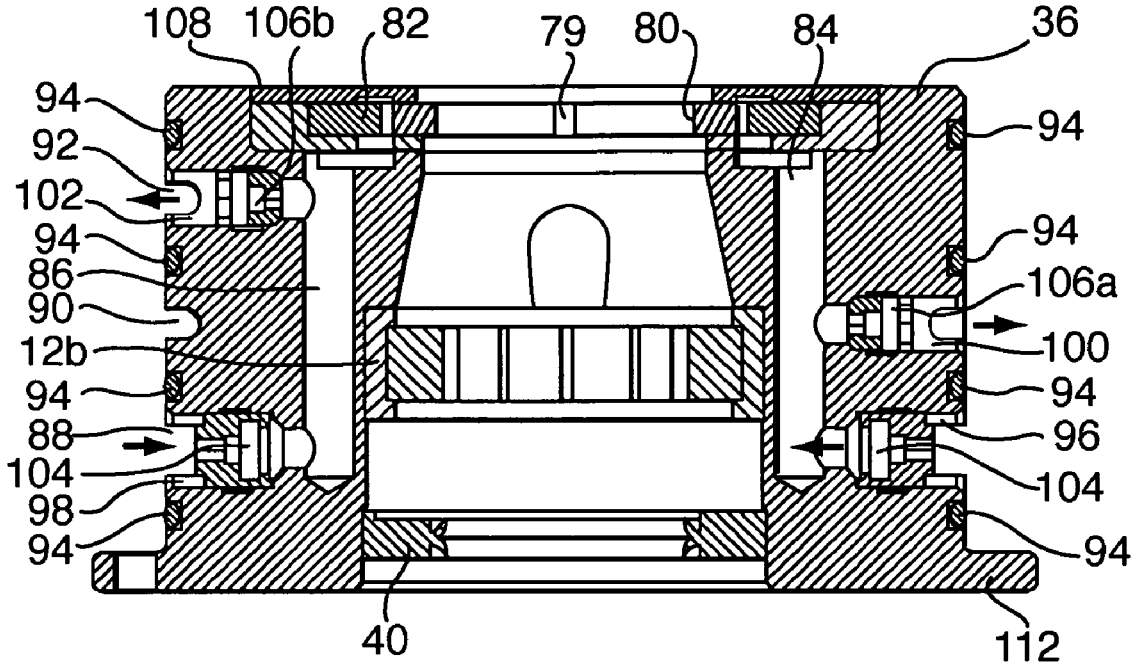
FIG. 6 is a section through a pump housing corresponding to section line A-A of FIG. 2, removed from the bearing housing.

Possible details of a useful pump are best illustrated in FIG. 6. The pump can be positioned substantially concentrically about shaft 6 and pump 16 may be keyed, by a pin 78/notch 79 arrangement or other means, to shaft 6 to be driven thereby. Pump 16 can be, for example, a positive displacement geroter style pump with a rotor 80 disposed concentrically about and connected to shaft 6 and a stator 82 in which rotor 80 acts. The pump can be positioned adjacent a first pump chamber 84 and a second pump chamber 86 and the pump can operate to move fluid between these chambers. Fluid flow between chambers 84, 86 is driven by the rotor/stator of the pump. The pump being bi-directional, rotor 80, depending on its direction of rotation, can move fluid from first pump chamber 84 to second pump chamber 86 and vice versa.

Pump 16 may be mounted in various ways to operate in the drivehead. The pump can be mounted directly within the bearing housing and the pump chambers 84, 86 can be mounted or formed in the bearing housing. As noted previously, the illustrated embodiment shows pump 16 mounted within a pump housing 36 and the pump housing mounted in a pump cavity 63 formed in the housing. A pump encased by a pump housing is illustrated in FIG. 6. In the illustrated embodiment, pump housing 36 encloses pump 16 by a top cover 108, for example secured by bolts or other means. In addition, pump housing 36 can also accommodate pump chambers 82, 84 and many mechanisms, such as check valves, seal 40 and bearing 12*b*. In such a configuration, any service required on these parts may be facilitated, since the pump housing can be removed as a unit from housing 10. Pump housing 36 can be secured in pump cavity 63 by removable fasteners such as bolts 110 secured through a flange 112 on the pump housing and into housing 10. Since the pump cavity may be open on a surface of the bearing housing and the pump housing may be secured by removable means such as bolts, the pump housing can be removed from the bearing housing, if necessary, to inspect or service any of the components in the pump housing. Of course, pump housing 36 and pump cavity 63, if employed, can be formed in other ways if desired.

Pump 16 cycles fluid from reservoir 12, as driven by shaft 6 and can control whether the fluid is conveyed to either the lubrication circuit or the brake assembly circuit depending on the direction of rotation of shaft 6. Of course, while pump is bi-directional it need not be, as lubrication or braking could be achieved by other means. For example, lubrication could be provided by grease packing the bearings and braking could be achieved, for example, by sensors and electrical driven control. However, a bi-directional pump provides a mechanism of braking and lubrication operable without external sensors or power sources.

The conduits for the fluid flow circuits may be formed and arranged in various ways to extend between the pump and the braking system and between the pump and the fluid reservoir. For example, the circuit conduits may be formed by internally or externally mounted lines and/or passages formed through the bearing housing and other parts. In one embodiment, the bearing housing is formed to accommodate lubricating flow circuits internally so that external lines can be reduced or eliminated, if desired. In the illustrated embodiments, for example, the only external fluid circuit lines are transfer lines 54*a*, 54*b* from one side of caliper 20 to the other. In the illustrated embodiments, main body 32 and cover 34 include internal passages 55*a*, 55*b*, which hereinafter may together be referred to as passage 55. Lubricating fluid can pass through passages 55*a*, 55*b* during its circulation, as driven by pump 16. An oil filter 56 can be mounted on housing 10 at a mount surface 58 where openings 60*a*, 60*b* to passages 55*a*, 55*b* are positioned, such that lubricating fluid can be filtered during its circuit. The lubrication circuit passages can include passage 55*a* extending from the pump to opening 60*a* at filter mount surface 58 and passage 55*b* extending from opening 60*b* to reservoir 14 above upper radial bearing 12*a*. Passage 55 may open to test nozzle 51, to provide access for fluid pressure tests. Where the drivehead includes pump cavity 63, it should be understood that passage 55*a* may extend only from an opening 62 in the pump cavity with further passages required through the pump housing to communicate from the pump to passage 55*a*.

Housing 10 can also include internal passages 64*a*, 64*b*, 64*c* for the braking circuit, which hereinafter may together be referred to as passage 64. For example, the brake circuit passages may include passage 64*a* from the pump to an opening 66 in communication with the pistons of caliper 20. Another passage 64*b* may extend from an inlet (cannot be seen clearly in any view) from the caliper to reservoir 14 above the upper radial bearing. Another passage 64*c* may extend from passage 64*a* to a relief valve 68. Where the drivehead includes pump cavity 63, it should again be understood that passage 64*a* may terminate at an opening 65 in pump cavity 63. Again, as noted above with respect to the lubrication circuit, further passages may be required through the pump housing to provide communication between the pump and passage 64*a*.

A passage 87 may also be formed between reservoir 14 and pump 16 to permit a flow of supply of fluid to the pump from the reservoir.

Where passages 55, 64 pass from main body 32 to cover 34, o-rings 70*a*, 70*b* or other means can be used to seal at the interface.

In the illustrated embodiments including a bi-directional pump, fluid for passages 55, 64 are fed from pump chambers 84, 86 and any supply passages, such as passage 87, open into the pump chambers. When driven by shaft 6, the pump cycles fluid from reservoir 12 to either lubrication passage 55 or brake passage 64 depending on the rotation of the pump rotor. Check valves, such as valves 104, 106*a*, 106*b*, may be provided between the pump chambers and the passages to ensure that the flow of fluid does not back flow through passage 87 into the reservoir but rather flows into either passage 55 or 64 and the circuits they define. For example, check valves 104 can limit flow only from reservoir to pump through passage 87, check valve 106*a* can limit flow only from the pump to lubrication passage 55 and check valve 106*b* can limit flow only from the pump to braking passage 64. While in the illustrated embodiments, check valves 104, 106*a*, 106*b* are shown mounted in the pump housing, it is to be understood that the check valves can be mounted to act with the pump regardless of how or where the pump and fluid circuits are mounted or formed.

Where a pump housing/pump cavity arrangement is used in a drivehead, a means for passing the fluid between the bearing housing and the pump must be provided. Thus, in the illustrated embodiment a fluid manifold is provided to convey fluid to and from the pump. The manifold can be formed between the pump housing and the pump cavity. In the illustrated embodiment, the outer surface of the pump housing, which faces the walls of pump cavity 63, defines a fluid manifold that is in communication with the pump. The fluid manifold includes fluid channels formed between the exterior of the pump housing and on the inner wall of the pump cavity. The channels may be formed by a first annular groove 88, a second annular groove 90 and a third annular groove 92. Seals 94, such as o-rings, are mounted in glands formed about grooves 88, 90, 92 such that they are each in fluid isolation. The grooves provide that fluid flow is directed to or from the pump. In particular, first annular groove 88 is open to reservoir 14 through passage 87 and is open to inlet ports 96, 98 to the first pump chamber and the second pump chamber, respectively. Second annular groove 90 is positioned on pump housing 36 to align with opening 62 in the pump cavity, when the pump housing is positioned in the pump cavity, and is open to an outlet port 100 from the first chamber. Third annular groove 92 is positioned on the pump housing to align with opening 65 in the pump cavity, when the pump housing is positioned in the pump cavity, and is open to an outlet port 102 from the second pump chamber. Check valves 104 may be mounted in inlet ports 96, 98 to permit flow only into the pump chambers and check valves 106*a*, 106*b* may be provided in outlet ports 100, 102 so that flow is only permitted therethrough out of the pump chambers. In the illustrated embodiment, the pump housing may include an exterior substantially cylindrical wall and the pump cavity includes a substantially cylindrical inner wall and the pump housing is mountable in the pump cavity with its exterior substantially cylindrical wall facing the pump cavity substantially cylindrical inner wall irrespective of its rotational position thereto. The annular grooves and valves of the manifold support this unrestricted positioning. Of course, the pump housing, the pump cavity and the manifold can have other configurations, such as for example, pump housing could be configured to control its rotational mounting position in the cavity or ports 100, 102, etc. and openings 62, 65, etc. could be repositioned, such that they align and the annular grooves need not be used.

As noted previously, the braking circuit may communicate with braking caliper 20. Caliper 20 can be connected to housing 10 in a radial manner and can accommodate both mounting and fluid communication at the connection. This can facilitate mounting the caliper and a radial mount configuration can facilitate access to the caliper. In the illustrated embodiment, for example, opening 66 and the opening from passage 64*b* can open radially on the bearing housing in a recess 120 sized to accept a mounting portion 122 of the caliper. Caliper 20 can include fluid passages 124 positioned to align with passages 64*a*, 64*b*. This configuration can permit caliper 20 to be bolted directly in a face-to-face configuration with housing 10 with o-rings 123 at the interfaces of the passages. Bolts 125 can be inserted radially to drive the two parts together. This connection can avoid the use of external fluid lines and can facilitate access to the rear of the caliper.

Caliper 20 can include an open back to allow service without removing the caliper from the housing or the brake rotor. In particular, an open area can be provided at the rear surface of caliper so that brake pads 26 can be observed. Lines 54*a*, 54*b* are positioned at the sides of the caliper so that brake pads 26 are not obstructed and they can be removed from the caliper while it remains attached to the bearing housing and about brake rotor 22.

Brake rotor 22 can be vented to facilitate heat dissipation. In the illustrated embodiment, brake rotor 22 is formed of a center hub 126 connected to a braking surface including an upper rotor ring 128 and a lower rotor ring 130 mounted together by ribs 132. A vent is, thereby, formed between each of the rings and the ribs through which cooling air can flow during brake rotor rotation. The center hub is connectable by key 24 to drive shaft 6. A tachometer reluctor 133 can be mounted to rotate with hub 126 and thereby to represent the rotation of drive shaft.

The drivehead can be formed by various processes and of various materials, as will be appreciated by those skilled in the art. In one embodiment, housing 10, including main body 32 and cover 34, can be formed by casting. Passages 55, 64 can be formed by drilling though the housing and plugging unnecessary bore holes. For example, in the illustrated embodiment of FIG. 2, an upper portion of passage 55*b*, in housing cover 34 is formed by drilling in from recess 120 and by inserting a plug 134 to direct the fluid flow.

In operation, a drivehead is assembled, as illustrated, and drive shaft 6 and polish rod 4 are rotated by sheave 8 to rotate the rotor of a downhole pump. Rotation of drive shaft 6 and axial load is borne by bearing housing 10 and the bearings 12*a*, 12*b*, 12*c* therein. Pump 16, being driven by the rotation of drive shaft 6, drives a lubrication circuit through passages 55. In particular, as shown by the arrows in the illustrated embodiments of FIG. 2, lubrication fluid from reservoir 14 can move through the housing into groove 88 of the pump manifold and is drawn through check valve 104 into first pump chamber 84, as pump is driven by regular forward rotation of the drive shaft. Pump rotor 80 moves fluid from the first pump chamber to second pump chamber 86 and this fluid is forced out through the check valve in outlet port 102 to enter annular groove 92. From annular groove 92, fluid moves through passage 55*a* to the oil filter and then back through passage 55*b* to the reservoir, where it bathes the bearings and then can be drawn again through the lubricating circuit.

Figure 4:
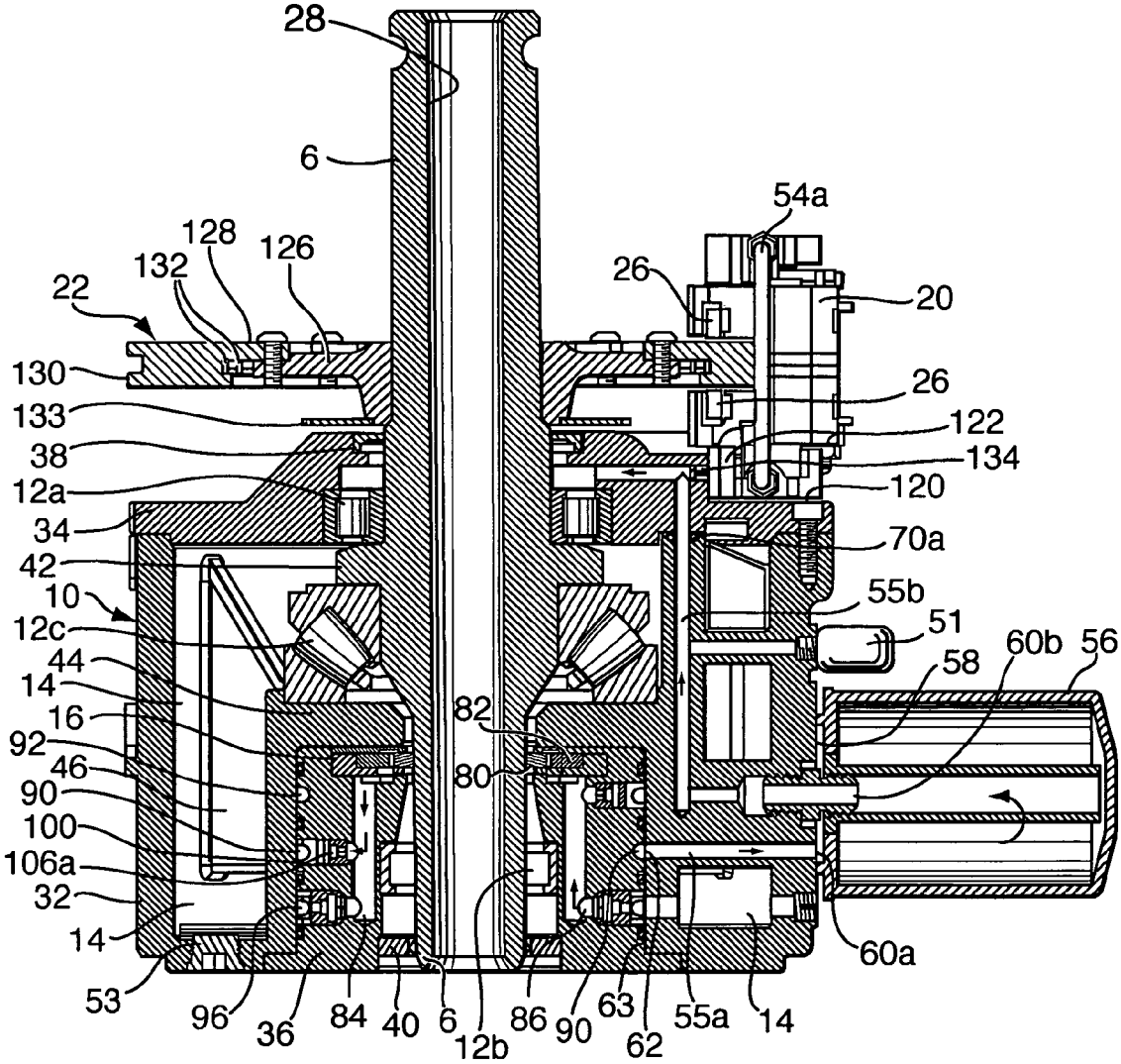
FIG. 4 is a section along line A-A of FIG. 2.
Figure 5:
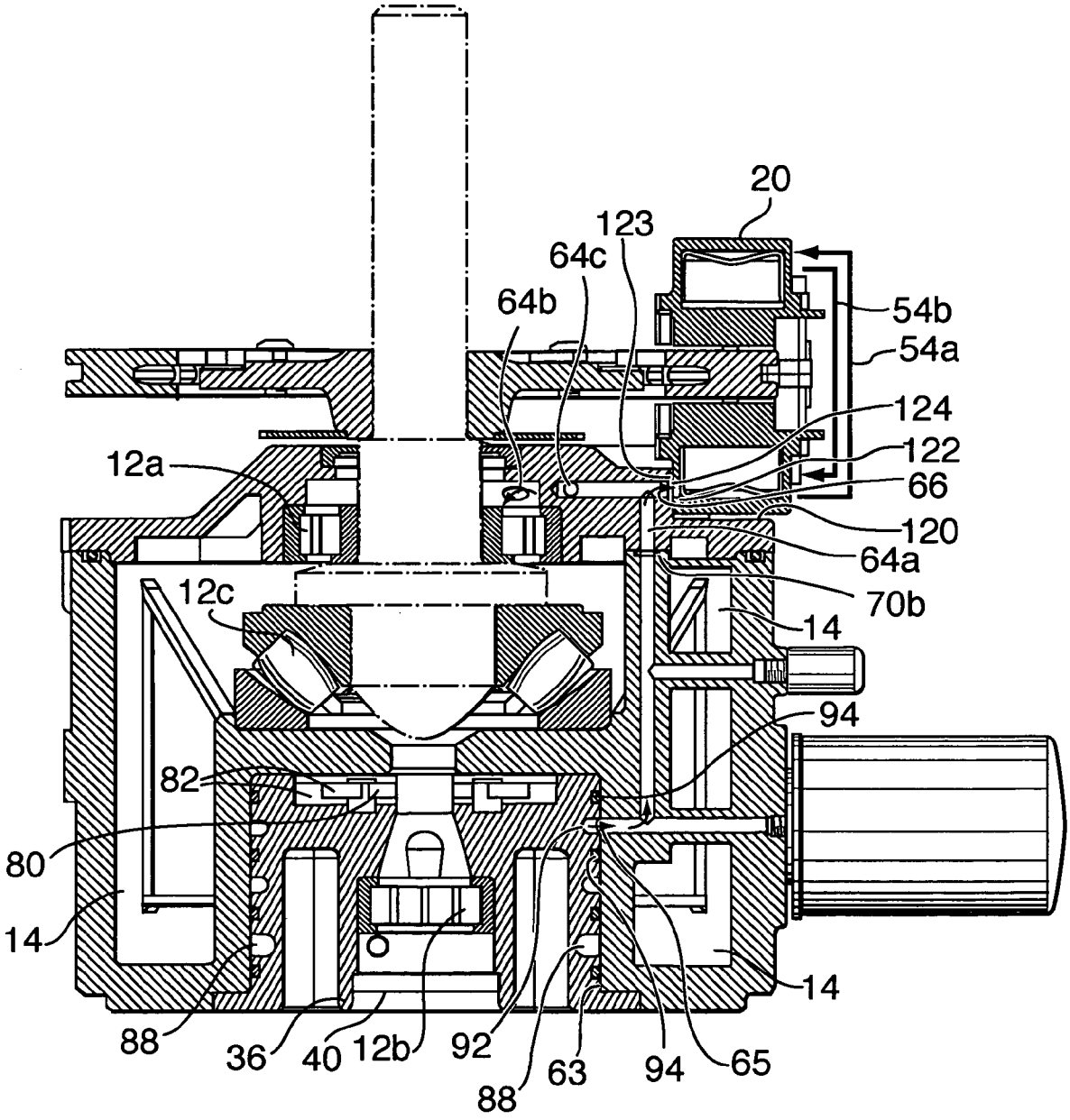
FIG. 5 is a section through the drivehead of FIG. 2, showing a braking fluid circuit.

To brake reverse rotation, brake rotor 22 can be mounted to rotate with shaft 6 and caliper 20 can be mounted to act on the rotor and to be in communication with a brake fluid circuit, as driven by pump 16. The pump, when driven in a reverse direction, as when torque is being released from the drive string, draws fluid from groove 88 into second pump chamber 86 and drives the fluid into first pump chamber 84 and out through the check valve in port 100 to groove 90. As shown by arrows in FIG. 4, from groove 90, fluid enters passage 64*a* and is driven to caliper 20. The fluid is conveyed in lines 54*a*, 54*b* from one side of the caliper to the other. Fluid pressure is translated by the caliper pistons to breaking force at brake pads 26 against rotor 22. As the braking causes shaft rotation to slow, the pump pressure is reduced so that pressure at the brake pads is eased off and the brake rotor and drive shaft are freed to continue back spin until all of the reactive torque in the drive string is dissipated or until the drivehead begins forward rotation again. Thus, the brake system is self regulating to permit controlled release of torque in the drive string. From caliper, fluid passes through passage 64*b* to the reservoir above bearing 12*a*, so that the bearings can be lubricated even during braking. Over pressure in the braking circuit can be relieved through relief valve 68. When reactive torque is dissipated, and the drive shaft's reverse spinning subsides to a lower allowable level, the caliper braking will be released so that the drive system is free to start up again.

With an embodiment including a pump mounted in an externally accessible pump cavity, should pump 16 or other components in pump housing 36 require servicing, inspection or cleaning, sheave 8 and other components are removed to permit bearing housing 10 and drive shaft 6 to be pulled up off the polish rod. The bolts can be removed and the pump including for example pump housing 36 and seals 94 can be pulled out of cavity 63.

It is to be understood that the embodiments of a vented rotor, a concentric bi-directional pump, a radial mounted or open backed caliper, removable pump housing possibly including bearings, seals and valves, accessible mounting of the pump in the housing and/or internal fluid passages can each be incorporated on their own into a drivehead or can be used alone or in various combinations.

Those skilled in the art will readily perceive how to modify the present invention still further. For example, many connections are shown as secured by threaded connectors, where they could be welded or formed otherwise, many connections are sealed by o-rings, where they could be formed by close tolerance, etc. Additionally, there are many other components and additional equipment that may be used within and in connection with or deleted from a drivehead.

As many possible embodiments may be made to the present invention, without departing from the scope thereof, it is to be understood that all matter herein disclosed or shown is to be interpreted as illustrative and not to be taken in a limiting sense.

What is claimed is:

1. A drivehead for driving a drive string of a rotary pump or motor, the drivehead comprising: a bearing housing for containing lubricating fluid therein; a driveshaft extending through the bearing housing and connectable into drive communication with the drive string and a pump disposed in the bearing housing concentric about the driveshaft, the pump selected to pump the lubricating fluid through the bearing housing as driven by the driveshaft and such that a fluid pressure output by the pump correlates to the speed of rotation of the driveshaft wherein the driveshaft is driven in a forward direction to drive the drive string and the driveshaft is driven in a reverse direction by release of reactive torque in the drive string and the drive string further comprising a braking assembly including a braking circuit and a hydraulic brake in the braking circuit, the braking assembly operable to brake reverse rotation of the driveshaft and wherein the pump is operable to provide self-regulation of the braking system such that slowing of driveshaft rotation in the reverse direction causes a decrease in the fluid pressure output by the pump to reduce pressure on the hydraulic brake and braking force output by the hydraulic brake.

2. The drivehead of claim 1 further comprising bearings in the bearing housing to support rotation of the driveshaft and wherein the pump is capable of pumping the lubricating fluid through the bearings.

3. The drivehead of claim 2 wherein the pump is bi-directional and pumps the lubricating fluid through the bearings when the driveshaft rotates in the forward direction and pumps the lubricating fluid through the braking system when the driveshaft rotates in the reverse direction.

4. The drivehead of claim 2 wherein the braking circuit opens into the bearing housing above the bearings after passing through the hydraulic brake.

5. A drivehead for driving a drive string of a rotary pump or motor, the drivehead comprising: a bearing housing for containing lubricating fluid therein, a driveshaft extending through the bearing housing and connectable into drive communication with the drive string: a pump disposed in the bearing housing concentric about the driveshaft, the pump selected to pump the lubricating fluid through the bearing housing as driven by the driveshaft, and the pump including a geroter-style rotor in drive communication to rotate with the driveshaft and a stator in which the rotor acts and a pump housing defining a first pump chamber and a second pump chamber and accommodating the rotor and the stator to move fluid between the first and the second pump chambers, as driven by rotation of the rotor; a pump cavity defined by the bearing housing and the pump housing being positionable therein; and a fluid manifold formed between the pump cavity and the pump housing.

6. The drivehead of claim 5 wherein the pump cavity is formed on an outer surface of the bearing housing and the pump housing is mountable in the pump cavity by removable fasteners.

7. A drivehead for driving a drive string of a rotary pump or motor, the drivehead comprising: a bearing housing for containing lubricating fluid therein; a driveshaft extending through the bearing housing and connectable into drive communication with the drive string; a pump cavity defined on an outer surface of the bearing housing; a pump disposed in the bearing housing concentric about the driveshaft, the pump selected to pump the lubricating fluid through the bearing housing as driven by the driveshaft; the pump including a pump housing about the pump installable in the pump cavity from the exterior of the bearing housing; and a fluid manifold formed between the pump housing and the pump cavity, the fluid manifold including fluid channels formed between the exterior of the pump housing and on the inner wall of the pump cavity.

8. The drivehead of claim 7 wherein the pump housing includes an exterior substantially cylindrical wall and the pump cavity includes a substantially cylindrical inner wall and the pump housing is mountable in the pump cavity with its exterior substantially cylindrical wall facing the pump cavity substantially cylindrical inner wall irrespective of its rotational position thereto.

9. The drivehead of claim 7 further comprising a lubrication fluid circuit formed through the wall of the bearing housing through which lubrication fluid can flow as driven by the pump.

10. A drivehead for driving a drive string of a rotary pump or motor, the drivehead comprising: a bearing housing for containing lubricating fluid therein; a driveshaft extending through the bearing housing and connectable into drive communication with the drive string; a pump disposed in the bearing housing concentric about the driveshaft, the pump selected to pump the lubricating fluid through the bearing housing as driven by the driveshaft; and a braking system for the driveshaft including a hydraulic brake caliper including pistons and a braking circuit formed through the wall of the bearing housing through which lubrication fluid can flow as driven by the pump, the braking circuit including a first passage through the bearing housing wall extending from an opening from the pump to an opening to the brake caliper and a second passage through the bearing housing wall extending from an opening from the brake caliper to an opening to a fluid reservoir in the bearing housing.

11. The drivehead of claim 10 wherein the brake caliper mounts against the bearing housing in communication with the openings from the first and second passages.

12. The drivehead of claim 10 wherein the brake caliper mounts in a radial manner against the bearing housing.

13. The drivehead of claim 10 wherein the brake caliper includes a mounting face mounted against the bearing housing a back side facing away from the bearing housing and the back side is open to permit access to brake pads of the brake caliper.

14. A drivehead for driving a drive string of a rotary pump or motor, the drivehead comprising: a bearing housing for containing lubricating fluid therein; a driveshaft extending through the bearing housing and connectable into drive communication with the drive string; a pump disposed in the bearing housing concentric about the driveshaft, the pump selected to pump the lubricating fluid through the bearing housing as driven by the driveshaft; and a braking system for the driveshaft including a brake rotor secured to rotate with the drive shaft, a hydraulic brake caliper including upper and lower brake pads and a braking fluid circuit through which lubrication fluid can flow as driven by the pump and wherein the brake rotor includes an upper rotor ring on which the upper brake pad acts, a lower rotor ring on which the lower brake pad acts and a vent opening therebetween.

* * * * *